US006595099B1

(12) United States Patent
Olson et al.

(10) Patent No.: US 6,595,099 B1
(45) Date of Patent: Jul. 22, 2003

(54) MULTIFUNCTIONAL FIREARM MUZZLE ATTACHMENTS

(75) Inventors: Douglas D. Olson, Vero Beach, FL (US); C. Reed Knight, Jr., Vero Beach, FL (US)

(73) Assignee: Knights Manufacturing Co., Vero Beach, FL (US)

( * ) Notice: Subject to any disclaimer, the term of this patent is extended or adjusted under 35 U.S.C. 154(b) by 0 days.

(21) Appl. No.: 10/139,776

(22) Filed: May 7, 2002

(51) Int. Cl.[7] ..... F41A 21/34
(52) U.S. Cl. ..... 89/14.2; 89/14.3
(58) Field of Search ..... 89/14.3, 14.4, 89/14.2

(56) References Cited

U.S. PATENT DOCUMENTS 1,174,165 A * 3/1916 Kenney ..... 89/14.3
2,558,200 A * 6/1951 Schmeling ..... 89/14.3
2,662,326 A * 12/1953 Powell ..... 89/14.3
4,057,003 A * 11/1977 Atchisson ..... 89/138
5,092,223 A * 3/1992 Hudson ..... 89/14.3

FOREIGN PATENT DOCUMENTS

WO WO 86/02438 * 4/1986 ..... 89/14.3

* cited by examiner

*Primary Examiner*—Stephen M. Johnson
(74) *Attorney, Agent, or Firm*—Carroll F. Palmer

(57) ABSTRACT

New multifunctional muzzle attachments for firearms providing substantial improvement in shooting accuracy in comparison with prior known muzzle attachments are disclosed that simultaneously provide a combination of four different functions, namely, (1) compensate for gun rise (aka muzzle climb), (2) serve to reduce recoil (aka muzzle braking), (3) reduce flash around the muzzle when the firearm is fired (flash hiding) and (4) an interface for a suppressor. This is made possible by the unique combination of (a) a slotted baffle fixed in the distal end of the new cylindrical attachments and (b) a plurality of longitudinal narrow slots between the distal and proximal ends spaced apart around and through the peripheral cylindrical wall.

11 Claims, 1 Drawing Sheet

MULTIFUNCTIONAL FIREARM MUZZLE ATTACHMENTS

BACKGROUND OF THE INVENTION

1. Field of the Invention

This application relates broadly to multifunctional attachments for firearm muzzles. More particularly, it concerns such attachments that can provide improvements over previously available firearm muzzle attachments simultaneously in three different functions when the firearm is fired, namely, (1) compensate for gun rise (aka muzzle rise), (2) reduce recoil (aka muzzle braking) and (3) reduce flash around the muzzle (aka flash hiding) thereby obtaining greater accuracy in use of firearms modified with muzzle attachments constructed in accordance with the invention.

2. Description of the Prior Art

Attachments to firearms have previously been provided to compensate for muzzle rise (aka muzzle climb) as disclosed in prior art patents, e.g., U.S. Pat. Nos. 5,585,590; 5,531,438; 5,794,374 and 6,308,609. Devices specifically designed to control muzzle rise are called "compensators".

Further, attachments to muzzles of firearms have previously been provided to reduce recoil (aka muzzle braking) as disclosed in prior art patents, e.g., U.S. Pat. Nos. 3,202,056; 5,279,200; 5,509,345; 5,612,504; 5,811,714; 5,652,406; 5,753,846; 5,814,757; 5,216,578 and 6,276,251. It should be noted that those skilled in firearm use recognize muzzle rise is a separate problem from recoil so the two require separate attention for superior firearm operation and accuracy.

Also, attachments to muzzles of firearms have previously been provided to reduce flash around the muzzle (aka flash hiding) as disclosed in prior art patents, e.g., U.S. Pat. Nos. 5,136,923; 5,596,161 and 6,298,764. It should be noted that those skilled in the art know that reduction in recoil typically produces an increase in muzzle flash.

An extensive discussion concerning the relationship of recoil, muzzle rise and flash suppression to firearm accuracy is contained in U.S. Pat. Nos. 5,794,375 (1L17 to 3L54) that is incorporated herein by reference.

The present invention provides further improvements in firearm muzzle attachments that make possible the simultaneous provision of all three of the functions discussed above by a single muzzle attachment to obtain accuracy improvements as compared with previously known firearms, particularly the M16/M4 series of rifles.

Additionally, the prior art has previously provided muzzle attachments by which suppressors (aka as silencers) can be mounted to the relevant firearm, e.g., see U.S. Pat. Nos. 4,939,977; 5,773,746 and others cited therein. The present invention also improves this function in its new improved muzzle attachments.

OBJECTS

A principal object of the invention is the provision of improvements in muzzle attachments for firearms that obtain profound increases in firing accuracy of the firearms to which they are applied.

A further object is the provision of multifunctional attachments for firearm muzzles that can provide improvement in three different functions simultaneously when the firearm is fired, namely, (1) compensate for muzzle rise, (2) reduce recoil and (3) reduce flash around the muzzle.

Another object is the provision of such muzzle attachments that have particular application to the M16/M4 series of rifles.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of improved multifunctional firearm muzzle attachments comprising a cylindrical member defined by a longitudinal axis, a circular distal end, a proximal end and a peripheral sidewall extending concentrically rearward from said distal end having its proximal end configured to attach to the muzzle of a firearm.

One feature of such improved attachment is a plurality of narrow parallel slots extending longitudinally along and through the peripheral sidewall with the narrow slots being equidistantly spaced from one another except for a non-slotted longitudinal portion of the sidewall.

Another feature of the improved attachments of the invention is a circular baffle fixed in the distal end having a concentric circular hole therein and a plurality of narrow radial slots therein defined by inner and outer ends spaced from each other and with the inner ends extending through the concentric circular hole.

In preferred embodiments of the invention the narrow parallel slots are between 0.015 and 0.020 inch in width, the narrow parallel slots number at least twenty and the non-slotted longitudinal portion of the sidewall has a width about between 15 to 20 percent the circumference of the peripheral sidewall.

Further in preferred embodiments, the concentric circular hole has a circumference slightly larger than the bore of the attached firearm and there are five of the narrow radial slots between 0.010 and 0.020 inch in width and equally spaced apart. Also, the distal end of the new attachments comprise at least one circumferential groove to accommodate the mounting of a suppressor to the attachment.

In preferred embodiments, the new firearm muzzle attachments are designed to be removable from the muzzles of firearms e.g., by threaded engaged with the firearm muzzle. Alternatively, the attachments may be permanently fastened to the firearm muzzle, e.g., by welding or machining integrally with the barrel.

The new multifunctional firearm muzzle attachments of the invention simultaneously provide increased reduction in gun rise, increased reduction in recoil and increased reduction in flash around the muzzle when new attachment modified firearms are fired thereby provided greater accuracy in the firing thereof.

BRIEF DESCRIPTION OF THE DRAWINGS

A more complete understanding of the invention can be obtained by reference to the accompanying drawings in which.

DESCRIPTION OF THE PREFERRED EMBODIMENTS

Figure 1:
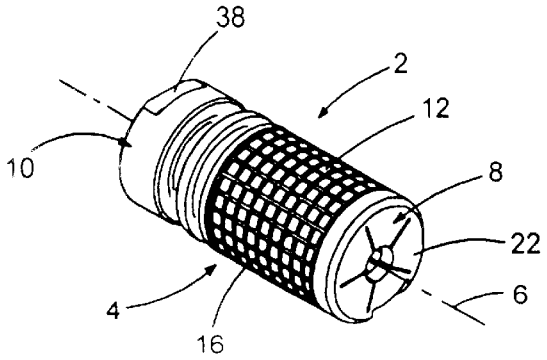
FIG. 1 is an isometric view of a firearm muzzle attachment of the invention viewed from its distal end.
Figure 2:
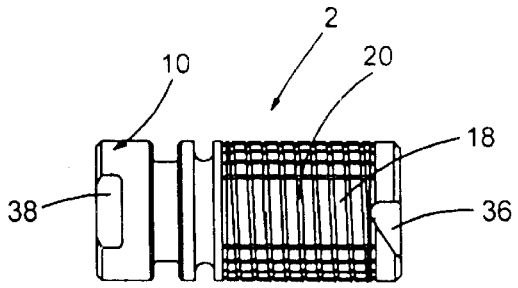
FIG. 2 is a bottom view of the firearm muzzle attachment of the invention.
Figure 3:
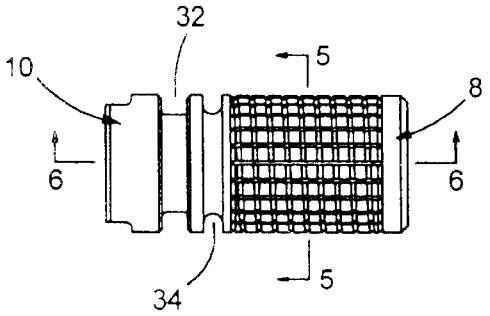
FIG. 3 is a lateral view of the firearm muzzle attachment of the invention.
Figure 4:
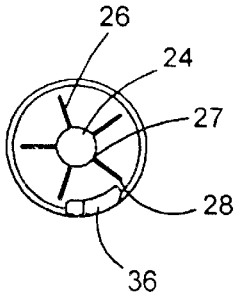
FIG. 4 is a distal end view of the firearm muzzle attachment of the invention.
Figure 5:
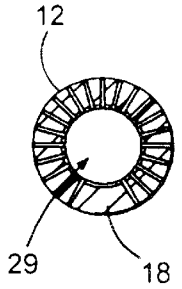
FIG. 5 is a sectional view taken on the line 5—5 of FIG. 3.

Referring in detail to the drawings, the improved multifunctional firearm muzzle attachment 2 comprises a cylindrical member 4 defined by a longitudinal axis 6, a circular distal end 8, a proximal end 10 and a peripheral sidewall 12 extending concentrically rearward from distal end 8. Advantageously, the distal end 8 is formed integral with sidewall 12, but it can be a separate element attached to the sidewall 12 such as by threads (not shown), welding (not shown) or equivalent.

Figure 6:
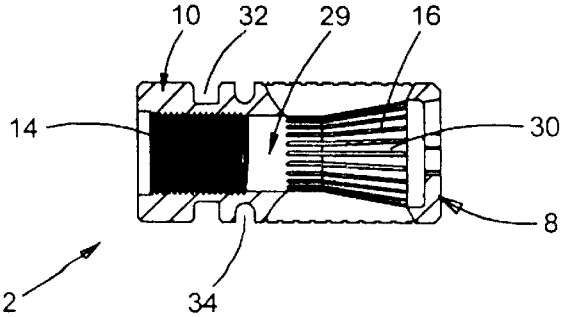
FIG. 6 is a sectional view taken on the line 6—6 of FIG. 3.

With reference to FIG. 6, the proximal end 10 has internal threads 14 to attach to the muzzle of a firearm not shown.

Twenty-one narrow parallel slots 16 extend longitudinally along and through the peripheral sidewall. They are equidistantly spaced from one another except for a non-slotted longitudinal portion 18 of sidewall 12. The non-slotted portion 18 faces vertically downward when the attachment 2 is fixed on a firearm (not shown) by threads 14 to the muzzle (not shown) on such firearm. Circumferential narrow grooves 20 depend from the outside surface of and partially into the sidewall 12 to assist in controlling flow of gases that issue through the longitudinal slots 16 when the firearm mounting the attachment 2 is fired. The longitudinal slots 16 are between 0.015 and 0.020 inch in width.

A circular baffle 22 is fixed across the distal end 8 of the attachment 2. The baffle comprises a concentric circular hole 24 and five narrow radial slots 26 defined by inner ends 27 & outer ends 28 that extend through the baffle 22. They are equidistantly spaced from each other, their inner ends 27 extend through the concentric circular hole 24 and the slots are between 0.010–0.20 in width.

Advantageously, the central bore 29 of attachment 2 has a outwardly flared distal end portion 30 to assist in the flow of propellant gases as they exit the bore 29 through the slots 16, slots 26 and hole 24.

The proximal end 10 of the new attachment 2 is cylindrical and contains a circumferential channel 32 and circumferential groove 34 positioned distally of proximal end to 10 so a blank firing device (not shown) interfaces with channel 32 and a suppressor (not shown) interfaces with groove 34. There is a cam notch 36 in the proximal end 10 to assist in removal of suppressors from attachment 2 against the resistance of carbon buildup created by firing of the firearms.

Ledges 38 are provided on the proximal end 10 to accept a wrench to assist in installing and removing the threaded attachment 2 from the muzzles of firearms.

EXAMPLE 1

A first series of tests were conducted with M4 carbines wherein each shooter fired ten three-round bursts at an E-size silhouette target at a range of 25 meters with a muzzle attachment of the invention installed in phase 1 and with the standard issue compensator in phase 2. The initial aim point was the X-ring. Any hit in the black on the silhouette was considered a hit. All of the shooters recorded hit probability increases of from 23.5% to 33.3% when using M193 ammunition in phase 1 as compared to phase 2.

A second series of tests were run using M 193 ammunition with five-round and thirty-round bursts which showed hit probability increases of from 15% to 20% in phase 1 as compared to phase 2. It was noted that the hit probability as a whole decreased with bursts greater than three rounds. This type of test is subject to the learning curve of the shooter in that later test scores show improvement over earlier test scores.

EXAMPLE 2

There was concern that the muzzle attachment of the invention could significantly detract from the performance of suppressors or would raise the level of the sound being imparted upon the shooter. However, it was found the with M855 ammunition the performance of a state of the art suppressor was actually improved by 1.6 db. The unsuppressed sound level perpendicular to the muzzle of the weapon was increased by less than 0.3 db with M855 ammunition. As with any device that effectively reduces recoil by redirecting the gas flow, there is an increase in the measured sound pressure level of the unsuppressed weapon at the shooters ear of approximately 11 db.

EXAMPLE 3

The unique muzzle attachments of the invention are effective muzzle brakes.

The recoil energy of M4 rifles is measured by suspending it on a pendulum. When the gun is fired it swings rearward and upward. By recording the extent of the rise one calculates the change in potential energy of M4 carbines is measured. If one neglects friction (which in this case is very small), conservation of energy dictates that the change in potential energy is equal to the net increase in the recoil energy of the gun when it is fired. This test was conducted utilizing M4 carbines firing M855 ammunition with a current state of the art flash hider and firing the same carbines fitted with the muzzle attachments of the invention. The weapon with the invention attachments displayed an average rise of 2.5 inches with a gun weight of 8.825 pounds which yields a change in potential energy of 1.84 ft-lb. The weapon with the current issue compensator displayed an average rise of 5.5 inches with a gun weight of 8.85 pounds which yields a change in potential energy of 4.06 ft-lb. The 55% reduction in recoil energy attained by the muzzle attachment of the invention makes the weapon easier to control as proven by an increase in hit probability like in Example 1.

The unique multifunctional muzzle attachments of the invention offer shooters a substantial increase in hit probability in burst and full auto fire with a broad range of ammunition types. Improved hit probability will become increasingly important as the barrel length is reduced and the energy of the round is decreased. In military operations, multiple hits on target will be required to incapacitate the enemy. Doing that in the shortest period of time will lead to burst fire so the improvement in hit probability provided by the new muzzle attachments can be critical. These new muzzle attachments supply a substantial improvement in the state of the art.

What is claimed is:

1. Improved multifunctional firearm muzzle attachments that provide increased reduction in flash around said muzzle when said firearm is fired comprising:

a cylindrical member defined by a longitudinal axis, a circular distal end, a proximal end, a central bore and a peripheral sidewall extending concentrically rearward from said distal end, said proximal end being configured to attach to the muzzle of a firearm, a plurality of narrow parallel slots between about 0.015 and 0.020 in width extending longitudinally along and through said peripheral sidewall, said narrow slots being equidistantly spaced from one another except for a non-slotted longitudinal portion of said sidewall, and a circular baffle fixed in said distal end having a concentric circular hole therein and a plurality of narrow radial slots therein defined by inner and outer ends spaced from each other and with said inner ends extending through said concentric circular hole.

2. The multifunctional firearm muzzle attachment of claim 1 wherein said narrow parallel slots number at least twenty.

3. The multifunctional firearm muzzle attachment of claim 1 wherein said non-slotted longitudinal portion of said sidewall has a width about between 15 to 20percent the circumference of said peripheral sidewall.

4. The multifunctional firearm muzzle attachment of claim 1 wherein there are five narrow radial slots between 0.010 and 0.020 inch in width and equally spaced apart in said circular baffle.

5. The multifunctional firearm muzzle attachment of claim 1 wherein said concentric circular hole has a circumference slightly larger than the bore of said firearm.

6. The multifunctional firearm muzzle attachment of claim 1 wherein said distal end comprises at least one circumferential groove to accommodate the mounting of a suppressor to said attachment.

7. The multifunctional firearm muzzle attachment of claim 1 that simultaneously provides increased reduction in gun rise, increased reduction in recoil and increased reduction in flash around said muzzle when said firearm is fired.

8. Improved multifunctional firearm muzzle attachments that provide increased reduction in flash around said muzzle when said firearm is fired comprising:

a cylindrical member defined by a longitudinal axis, a circular distal end, a proximal end, a central bore and a peripheral sidewall extending concentrically rearward from said distal end, said proximal end being internally threaded to attach to the muzzle of a firearm, an outwardly tapered distal end portion in said central bore, a plurality of narrow parallel slots between about 0.015 and 0.020 in width extending longitudinally along and through said peripheral sidewall, said narrow slots being equidistantly spaced from one another except for a non-slotted longitudinal portion of said sidewall, a circular baffle fixed in said distal end having a concentric circular hole therein and a plurality of narrow radial slots between about 0.015 and 0.020 in width therein defined by inner and outer ends spaced from each other and with said inner ends extending through said concentric circular hole and said proximal end is cylindrical and contains at least one circumferential groove positioned distally of said proximal end to interface with a suppressor.

9. In a firearm muzzle attachment having a cylindrical member defined by a longitudinal axis, a circular distal end, a proximal end, a central bore and a peripheral sidewall extending concentrically rearward from said distal end with said proximal end being internally threaded to attach to the muzzle of a firearm, the improvements that render said attachment to uniquely and simultaneously compensate for gun rise, reduce recoil and reduce flash around said muzzle when said firearm is fired that comprise:

a plurality of narrow parallel slots between about 0.015 and 0.020 in width extending longitudinally along and through said peripheral sidewall, said narrow slots being equidistantly spaced from one another except for a non-slotted longitudinal portion of said sidewall, and a circular baffle fixed in said distal end having a concentric circular hole therein and a plurality of narrow radial slots between about 0.015 and 0.020 in width therein defined by inner and outer ends spaced from each other and with said inner ends extending into said concentric circular hole.

10. In a firearm muzzle attachment having a cylindrical member defined by a longitudinal axis, a circular distal end, a proximal end, a central bore and a peripheral sidewall extending concentrically rearward from said distal end with said proximal end being internally threaded to attach to the muzzle of a firearm, the improvements that render said attachment to uniquely and simultaneously compensate for gun rise, serve to reduce recoil, reduce flash around said muzzle when said firearm is fired and interface with a suppressor that comprise:

a plurality of narrow parallel slots between about 0.015 and 0.020 in width extending longitudinally along and through said peripheral sidewall, said narrow slots being equidistantly spaced from one another except for a non-slotted longitudinal portion of said sidewall, a circular baffle fixed in said distal end having a concentric circular hole therein and a plurality of narrow radial slots between about 0.015 and 0.020 in width therein defined by inner and outer ends spaced from each other and with said inner ends extending through said concentric circular hole and said proximal end is cylindrical and contains a circumferential surface configuration positioned distally of said proximal end to interface with a suppressor.

11. The firearm muzzle attachment of claim 10 wherein said central bore tapers outwardly toward its distal end.

* * * * *